US006481069B1

(12) United States Patent
Cheng

(10) Patent No.: US 6,481,069 B1
(45) Date of Patent: Nov. 19, 2002

(54) BRACELET CONNECTOR

(76) Inventor: Howard Cheng, 2821 S. Quinn St., Chicago, IL (US) 60608

( * ) Notice: Subject to any disclaimer, the term of this patent is extended or adjusted under 35 U.S.C. 154(b) by 0 days.

(21) Appl. No.: 09/690,225

(22) Filed: Oct. 17, 2000

(51) Int. Cl.[7] ..... A44B 11/00
(52) U.S. Cl. ..... 24/647; 24/537; 24/645
(58) Field of Search ..... 24/537–541, 609, 24/616, 636, 649, 643–647, 650; 63/15–15.65, 3, 12, 13; 403/102, 315, 316

(56) References Cited

U.S. PATENT DOCUMENTS

| | | | | | |
|---|---|---|---|---|---|
| 369,067 | A | * | 8/1887 | MacMillan | 24/647 X |
| 468,677 | A | | 2/1892 | Maxheimer et al. | |
| 1,551,404 | A | | 8/1925 | Kennison | |
| 3,177,547 | A | * | 4/1965 | Wisniewski | 24/647 |
| 3,653,694 | A | * | 4/1972 | Nicol | 285/334.4 |
| 3,868,762 | A | * | 3/1975 | Nilsson | 29/470.1 |
| 4,001,923 | A | * | 1/1977 | Frankel et al. | 24/665 |
| 4,286,360 | A | * | 9/1981 | Skobel | 63/21 |
| 4,566,157 | A | * | 1/1986 | Packendorff | 24/537 X |
| 4,593,440 | A | | 6/1986 | Tsamas | 24/265 |
| 4,606,098 | A | | 8/1986 | Akahane | 24/326 |
| 4,675,955 | A | | 6/1987 | Nakamura | 24/656 |
| 4,924,562 | A | * | 5/1990 | Pogharian | 24/647 |
| 4,958,420 | A | | 9/1990 | Bunz | 24/653 |
| 5,136,858 | A | * | 8/1992 | Bruner | 24/650 X |
| 5,313,691 | A | | 5/1994 | Hashimoto | 24/69 |
| 5,359,755 | A | * | 11/1994 | Dalton et al. | 24/537 X |
| 5,435,047 | A | * | 7/1995 | Colpo | 24/647 |
| 5,787,554 | A | | 8/1998 | Hashimoto | 24/68 |
| 5,826,309 | A | | 10/1998 | Tasmas | 24/68 |
| 5,868,459 | A | * | 2/1999 | Welsh, Jr. | 403/102 X |
| 6,003,213 | A | * | 12/1999 | Keller et al. | 24/635 |
| 6,058,576 | A | | 5/2000 | Harris | 24/265 |
| 6,301,757 | B1 | * | 10/2001 | Kunii et al. | 24/636 |

FOREIGN PATENT DOCUMENTS

EP 0 046 123 A1 * 11/1981

* cited by examiner

*Primary Examiner*—Robert J. Sandy
*Assistant Examiner*—Ruth C. Rodriguez
(74) *Attorney, Agent, or Firm*—Andrus, Sceales, Starke & Sawall

(57) ABSTRACT

A jewelry clasp used to secure a piece of jewelry to an individual. The clasp includes a female part attached to one end of the piece of jewelry that has a latch pivotally mounted within a recess on the female part. The latch includes a hook at one end having an outer sloping surface. The clasp also includes a male part attached to the opposite end of the piece of jewelry and including a loop. The loop has a crossbar at its outer end which has an outer sloping wall. The outer wall of the crossbar and the outer surface of the hooks slope in similar directions, such that when the crossbar is pressed against the hook, the hook slides upwardly with respect to the crossbar, until the hook passes over the crossbar and drops through the center of the loop to engage the loop. The clasp also includes a sleeve slidably mounted to the male part that selectively covers the engagement of the male part and female part when the clasp is in the engaged position.

4 Claims, 2 Drawing Sheets

BRACELET CONNECTOR

FIELD OF THE INVENTION

The present invention relates generally to pieces of jewelry and more specifically to connectors or clasps for securing the end of jewelry strand pieces around a body part of an individual.

BACKGROUND OF THE INVENTION

Items of jewelry such as bracelets and necklaces are normally attached to a person wearing the jewelry utilizing a connector or a clasp. The clasp normally consists of a loop attached to one end of the jewelry piece and a connecting member located at the opposite end. The connecting member usually includes a spring-biased arm or latch that is movable from a closed or engaged position to an open or disengaged position in order to enable the loop to be positioned within the connecting member. The spring biases the latch into the closed position, such that once the loop is positioned beneath or within the latch, the latch is released and urged into the closed position by the spring to engage the loop.

One type of necklace clasp is shown in Maxheimer et al U.S. Pat. No. 468,677. In this clasp, a clip includes a clutch-head downwardly depending from one end and a pin extending from the opposite end that is engaged with a spring. The spring biases the clip into the closed position such that the clutch head is enclosed within a box. To engage the clip with a spring-catch, the clip is manually pivoted against the bias of the spring to remove the clutch-head from the box. The spring-catch is inserted into the box, and the clip is released, allowing the spring to urge the clip to engage the spring-catch.

Another example of a spring-bias clip is shown in Frankel et al U.S. Pat. No. 4,001,923. In this clasp, a nose portion on a male member is releasably engaged by a spring-biased locking member disposed in a female member. When the locking member is depressed, an aperture on the locking member aligns with the nose, allowing the male member and nose to be removed from the female member.

Because most pieces of jewelry require clasps similar to those described above, which are very small so as not to detract from the aesthetically pleasing appearance of the jewelry, the clasps are often very difficult to operate due to their small size. The reason for these difficulties is that any tab or protrusion on the latch that is grasped or depressed to move the latch from the engaged position to the disengaged position corresponds in size to the overall size of the clasp. As a result, it is often difficult to properly grasp or depress the tab in order to move the latch. Further, the tabs or protrusions extending from the latches on these types of clasps also present the problems with regard to the snagging of the tabs on articles of clothing, hair, etc.

Therefore, it is desirable to develop a clasp for items of jewelry that is easily engaged and disengaged to secure an item of jewelry on an individual. The clasp optimally should not include any tabs or other protrusions extending outwardly from the body of the clasp that would snag on articles of clothing. It would also be most desirable to have a clasp that could be made substantially completely of precious metal, so that the clasp would be compatible with a precious metal bracelet or necklace with which it was used.

SUMMARY OF THE INVENTION

It is an object of the present invention to provide a jewelry clasp that can be engaged without needing to grasp and pivot a latch located on the clasp.

It is another object of the invention to provide a jewelry clasp that does not include any outwardly projecting tabs capable of snagging on articles of clothing and the like.

It is still another object of the invention to provide a jewelry clasp having the above features that is inexpensive to manufacture and utilize with numerous different pieces of jewelry.

It is still a further object of the invention to provide a jewelry clasp having a safety sleeve slidably mounted to one portion of the clasp to cover the engaged portions of the clasp when the piece of jewelry is being worn by an individual. The sleeve prevents any inadvertent disengagement of the clasp and also prevents any foreign objects from being lodged between the engaged portions of the clasp.

It is still a further object of the invention to provide a jewelry clasp having the above features that is made almost entirely of a precious metal.

The present invention is a jewelry clasp used to secure opposite ends of a piece of jewelry around a body part of an individual. The clasp includes a female receiving part attached to one end of the jewelry piece. The receiving part includes a latch pivotally mounted within the receiving part and having a downwardly projecting hook at one end. The hook has a outer sloping surface and an inner curved surface. The hook projects downwardly into the receiving part and intersects a slot that extends inwardly from one end of the receiving part.

The clasp also includes a male engaging part that is attached to the piece of jewelry opposite the female receiving part. The male engaging part includes a base portion secured to the jewelry piece and a catch, such as a loop extending opposite the jewelry piece. The loop is formed by a pair of parallel outwardly extending legs and a crossbar extending between the legs opposite the base portion. The crossbar includes a sloping outer wall that slopes in the same direction as the direction of the outer surface of the hook.

To connect the male engaging portion with the female receiving portion in order to engage the clasp, the crossbar of the loop on the male engaging portion is pressed against the hook on the female receiving portion. The sloping outer wall on the crossbar contacts the outer sloping surface on the hook and, due to the similar slopes of the sloping sections, urges the hook and latch upwardly with respect to the loop on the male receiving part. Once the hook has been raised completely over the loop, the hook passes over the crossbar and then drops downwardly into an opening defined within the loop to retain the crossbar portion of the loop within the female receiving part. To disengage the clasp, an individual grasps a flange extending forwardly from the latch above the hook and pivots the latch upwardly away from the receiving part. Once the hook is completely removed from within the loop, the male engaging part can be removed from the female receiving part.

The clasp also includes a sleeve slidably mounted to the male engaging part. The sleeve is slidably connected to the engaging part by the engagement of a tab extending inwardly from the sleeve with a groove extending longitudinally along one side of the male engaging part. The sleeve can have a cross-sectional area adjacent the tab slightly larger than the cross-sectional area of the male engaging part, and can either flare outwardly such that the end of the sleeve opposite the tab has a cross-sectional area greater than the cross-sectional area adjacent the tab or angle inwardly to provide a friction fit between the sleeve and the female part when the sleeve is used. Once the male engaging part has been engaged with the female receiving part, the sleeve may be slid along the male part to cover the engagement between the respective male and female clasp parts. Thus, the sleeve serves to prevent any objects from becoming entangled between the respective parts of the clasp, and also prevents any object from inadvertently disengaging the clasp.

Various other features, objects and advantages of the invention will be made apparent from the following detailed description taken together with the drawings.

BRIEF DESCRIPTION OF THE DRAWINGS

The following drawings illustrate the presently preferred embodiment of the present invention.

In the drawings.

DETAILED DESCRIPTION OF THE INVENTION

Figure 1:
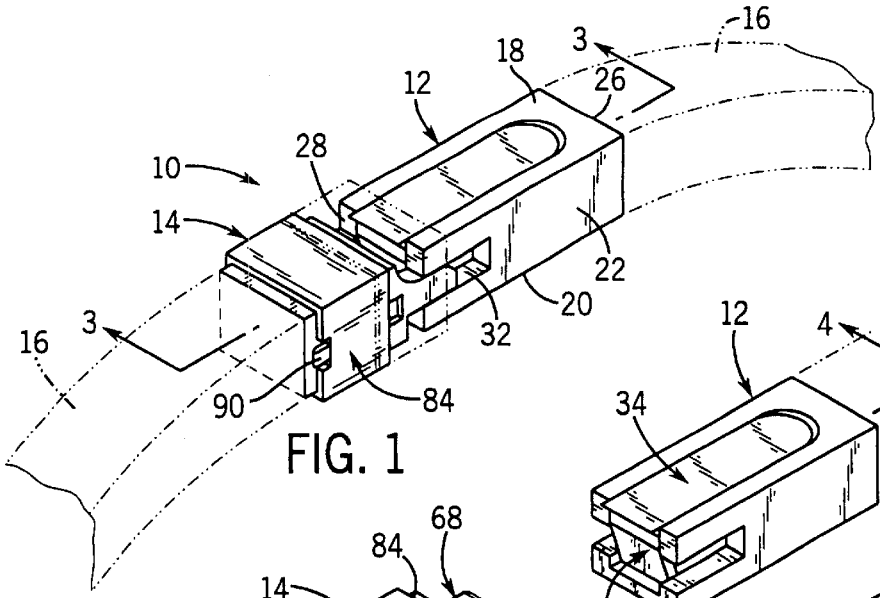
FIG. 1 is a perspective view of the clasp of the present invention in the engaged position.
Figure 2:
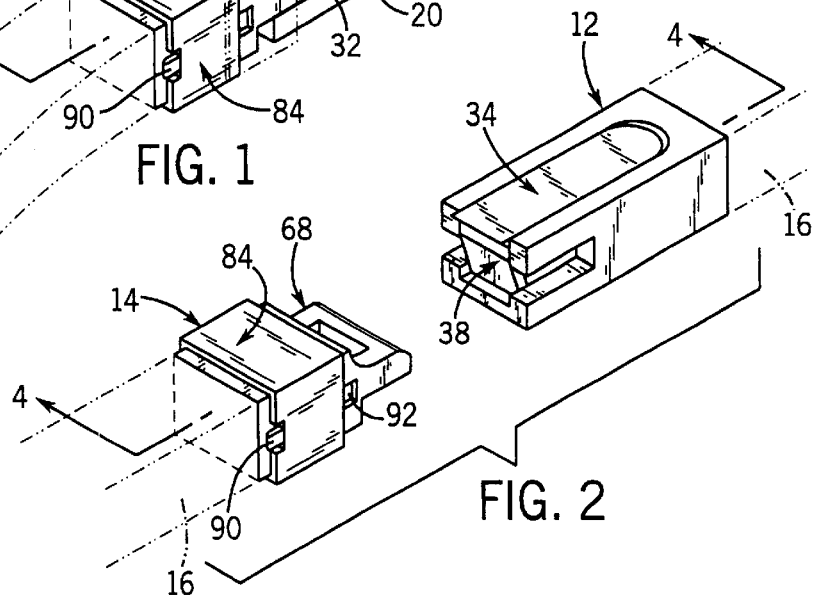
FIG. 2 is a perspective view of the clasp of FIG. 1 in the disengaged position.
Figure 3:
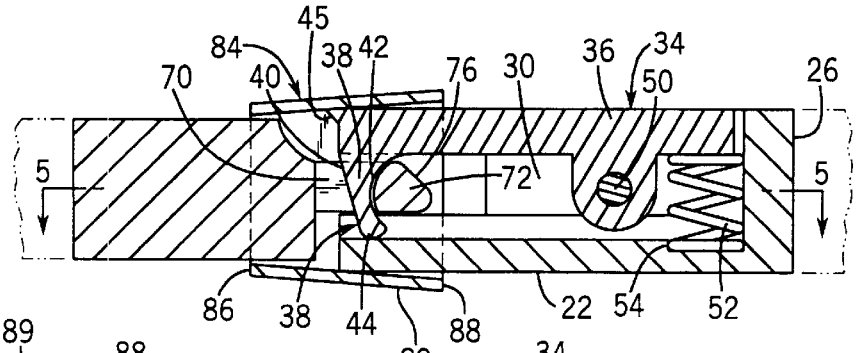
FIG. 3 is a cross-sectional view along line 3—3 of FIG. 1.
Figure 4:
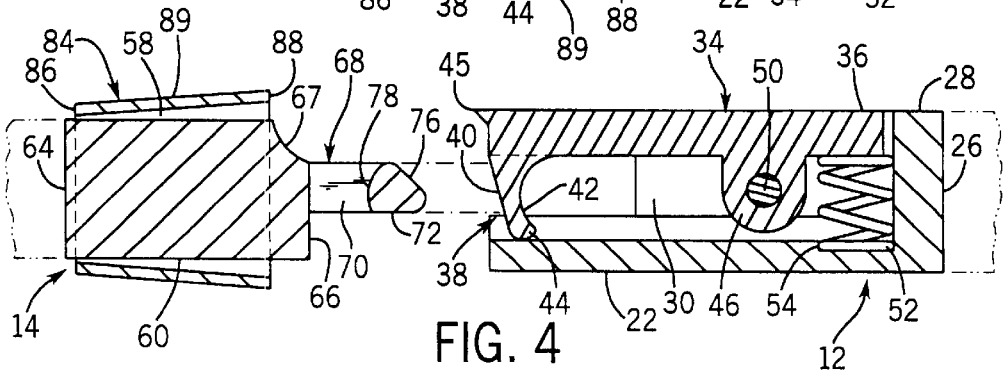
FIG. 4 is a cross-sectional view along line 4—4 of FIG. 2.

With reference now to the drawing figures in which like reference numerals designate like parts throughout the disclosure, the jewelry clasp of the present invention is indicated in FIG. 1 generally at 10. The clasp 10 includes a female part 12 and a male part 14 secured to opposite ends of a jewelry piece 16, such as a necklace, bracelet, watch band or the like.

Referring now to FIGS. 2–6, the female part 12 is generally rectangular in shape and includes a top end 20, a bottom end 22, a pair of side ends 24 joining top end 20 and bottom end 22, a rear end 26 and a front end 28. The female part 12 includes a recess 30 extending from the front end 28 to a point adjacent the rear end 26, and from a point above the bottom end 22 through the top end 20. The female part 12 further includes a slot 32 extending inwardly from the front end 28 through the side ends 24, the slot 32 intersecting the recess 30.

A latch 34 is pivotally mounted within the recess 30 and includes an upper portion 36 mounted flush with the top end 20. Adjacent the front end 28, the latch 34 also includes a downwardly depending hook 38 that includes an outer sloping surface 40 and an inner curved surface 42. The outer surface 40 and inner surface 42 meet at a tip 44 at the lowermost end of the hook 38. A flange 45 extends outwardly from the upper portion 36 above the hook 38 and is used to manually pivot latch 34. Spaced from the hook 38, the latch 34 also includes a mounting portion 46 depending downwardly from the upper portion 36. The mounting portion 46 defines a channel 48 extending therethrough that receives a pivot pin 50 mounted between the side ends 24 of the female part 12.

Between the mounting portion 46 and rear end 26, the recess 30 encloses a spring 52. The spring 52 is disposed within a notch 54 in the bottom end 22 adjacent the rear end 26 and extends upwardly to engage the upper portion 36 of latch 34 opposite the hook 38. Thus, the spring 52 functions to bias the latch 34 into a closed position where the tip 44 of the hook 38 contacts the bottom end 22 and the upper portion 36 is flush with the top end 20.

The male part 14 of the clasp 12 includes a base portion 56 that is generally rectangular in shape and includes a top wall 58, a bottom wall 60, a pair of side walls 62 joining the top wall 58 and bottom wall 60, a rear wall 64 and a front wall 66. The front wall 66 also includes a curved section 67 extending between the front wall 66 and the top wall 58. The male part 14 also includes a latch, such as a loop 68 extending perpendicularly from the front wall 66. The loop 68 includes a pair of outwardly extending legs 70 and a cross bar 72 extending between the legs 70 opposite the front wall 66. The loop 68 defines a central opening 74 between the front wall 66, legs 70 and cross bar 72 that is used to engage the male part 14 with the female part 12. The cross bar 72 includes an outer sloping wall 76 and an inner curved wall 78. The outer sloping wall 76 slopes in the same direction as the outer sloping surface 40 on hook 38.

Figure 5:
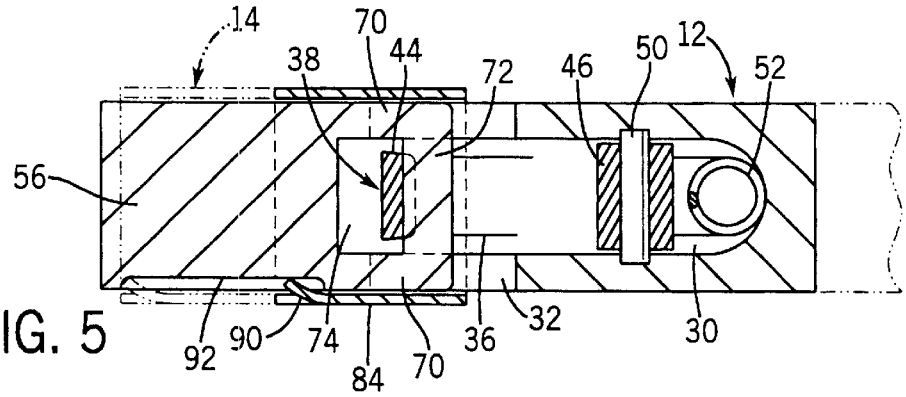
FIG. 5 is a cross-sectional view along line 5—5 of FIG. 3.
Figure 6:
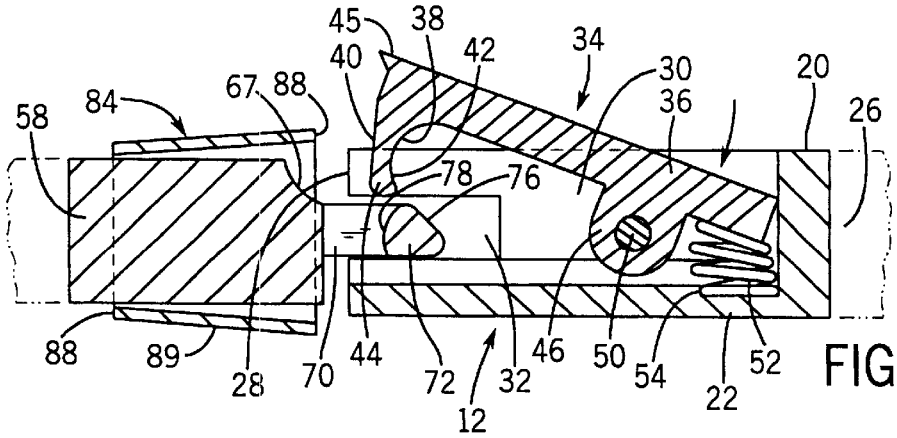
FIG. 6 is a cross-section view similar to FIGS. 3 and 4 illustrating the engagement of the clasp of FIG. 1.
Figure 7:
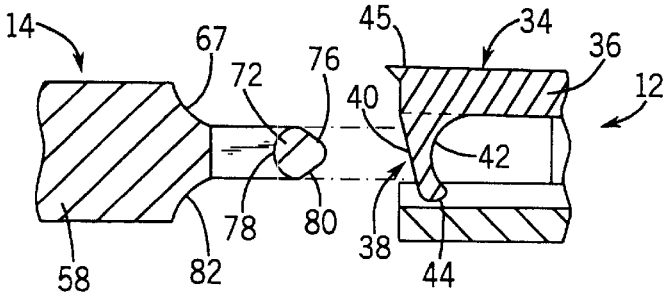
FIG. 7 is a partial cross-sectional view similar to FIG. 4 illustrating a second embodiment of the clasp of the present invention.

Referring now to FIGS. 3–6, to engage the male part 14 with the female part 12, the outer sloping wall 76 on crossbar 72 is pressed against the outer sloping surface 40 of the hook 38 such that the surface 40 and wall 76 slide with respect to each other and the hook 38 is urged upwardly over the cross bar 72. Once the hook 38 has cleared the cross bar 72, the cross bar 72 and leg 70 of loop 68 can enter the slot 32 and recess 30 in the female part 12, allowing the tip 44 of the hook 38 to be guided into the central opening 74 of the loop 68 by the inner curved wall 78 on the cross bar 72. The cross bar 72 may also take a number of alternative forms such as having a flat outer wall (not shown) or, as shown in FIG. 7, a second outer sloping wall 80 and a corresponding second curved surface 82 on the front wall 66 that are disposed opposite the first curved section 67 and first outer sloping wall 76 to enable the cross bar 72 to be engaged with the hook 38 and female member 12 when the male member 14 is either upright or inverted. The reason why the various embodiments of the cross bar 72 can be used is because the slope of the outer sloping surface 40 can engage and slide with respect to an outer wall of almost any shape on the loop 68 in order to operate and engage the clasp 10.

The male part 14 also includes a covering sleeve 84 that is slidably mounted to the base portion 56 of the male member 14. The sleeve 84 has a first end 86 that is slidably connected to the base portion 56 and a cross-sectional area slightly larger than the base portion 56, a second end 88 spaced from the first end 86 having a cross-sectional area less than that of the female part 12. This enables the second end 88 to frictionally engage the female part 12 to retain the sleeve 84 over the connection between the male part 14 and female part 12. Alternatively, the second end 88 can have a cross-sectional area greater than that of the first end 86 and outwardly flaring side walls 89 as shown in FIG. 6. The sleeve 84 is mounted to the base portion 56 by an inwardly extending tab 90 disposed on one side of the sleeve 84 and received within a groove 92 extending along one side wall 62 of the base portion 56. When the male part 14 is completely engaged within the female part 12, the sleeve 84 may be slid along the groove 92 to position the sleeve 84 over the connected ends of the female part 12 and male part 14 to prevent any inadvertent disengagement of the connection between the female part 12 and male part 14. The groove 92 limits the travel of the sleeve along the clasp.

To disengage the clasp 10, first the covering sleeve 84 is slid away from its covering position shown in FIG. 5 back onto the base portion 56 of the male part 14. An individual then grasps the flange 45 extending from the latch 34 above the hook 38 and pulls upwardly on the flange 45, as with a fingernail. The latch 34 moves upwardly against the bias of the spring 52 until the tip 44 of the hook 38 is completely displaced from within the loop 68. The loop 68 may be then slid outwardly from the slot 32 and recess 30, disengaging the male part 14 from the female part 12.

Figure 8:
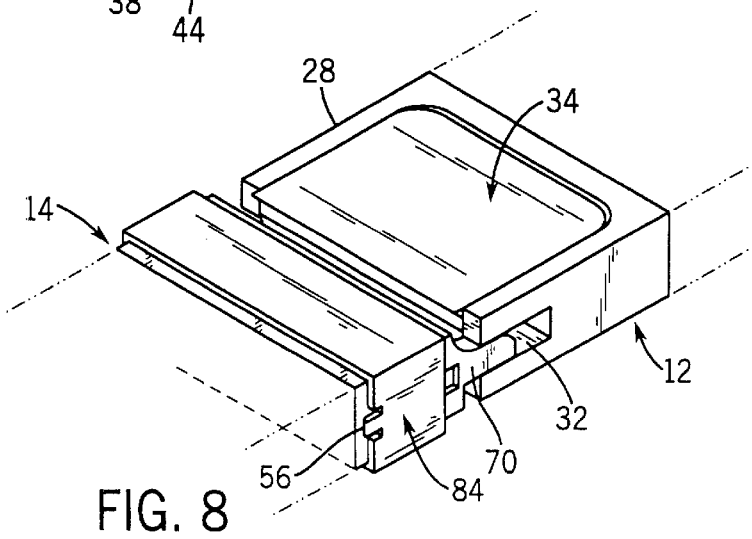
FIG. 8 is a perspective view of a third embodiment of the clasp of the present invention.

In another embodiment of the invention, the clasp 10' may be formed with an enlarged female part 12 and male part 14 as shown in FIG. 8 to releasably secure various pieces of jewelry to an individual such as a watch.

Various alternatives and embodiments to the construction of the clasp 10 of the present invention are contemplated and covered by the following claims particularly pointing out and distinctly claming the subject matter of the present invention.

I claim:

1. A device for securing opposite ends of a piece of jewelry together comprising:

a female part adapted to be attached to one end of the piece of jewelry, the female part defining a recess extending longitudinally along the female part, and a laterally extending slot at one end of the female part, the slot intersecting the recess;

a pivot pin disposed on the female part within the recess and spaced from the slot;

a latch mounted to the pivot pin within the recess, the latch including a hook at one end that has an outer sloping surface;

a spring disposed within the recess and spaced from the slot, the spring contacting the latch opposite the hook to bias the latch and hook into a closed position within the recess;

a male part adapted to be attached to the other end of the piece of jewelry, the male part releasably engageable with the female part and including a base portion and a catch attached to the base portion, the catch defining an opening receivable within the female part and adapted to engage and urge the latch into an opened position by contacting the outer sloping surface and permitting the latch to return to the closed position to secure the catch within the female part;

the female part having a cross-section slightly greater than the cross-section of the male part; and, a sleeve slidably mounted to the male part and adapted to selectively cover an engagement of the male part and female part, said sleeve tapering along its length to define a smaller cross-section on the male side of the engagement and a greater cross-section on the female side of the engagement, whereby the sleeve will frictionally engage the female part to retain said sleeve over said engagement.

2. The device of claim 1 wherein the sleeve includes an inwardly extending tab that is slidably engaged within a longitudinally extending groove on the male part to limit slidable movement of the sleeve.

3. The device of claim 1 wherein the catch includes a crossbar and the crossbar has a curved inner wall that guides the hook into the opening within the loop.

4. The device of claim 3 wherein the inner curved surface of the hook includes a tip that engages the crossbar to retain the male part in engagement with the female part.

* * * * *